US010843315B2

(12) United States Patent
Wallgren

(10) Patent No.: US 10,843,315 B2
(45) Date of Patent: Nov. 24, 2020

(54) METHOD AND A POWER TOOL FOR ERROR PROOF SCREW JOINT TIGHTENING

(71) Applicant: ATLAS COPCO INDUSTRIAL TECHNIQUE AB, Stockholm (SE)

(72) Inventor: Carl Johan Erik Wallgren, Stockholm (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 308 days.

(21) Appl. No.: 15/736,189

(22) PCT Filed: Jun. 13, 2016

(86) PCT No.: PCT/EP2016/063471

§ 371 (c)(1),
(2) Date: Dec. 13, 2017

(87) PCT Pub. No.: WO2017/001175

PCT Pub. Date: Jan. 5, 2017

(65) Prior Publication Data

US 2018/0169842 A1 Jun. 21, 2018

(30) Foreign Application Priority Data

Jun. 30, 2015 (SE) ..... 1550911

(51) Int. Cl.
*B25B 23/147* (2006.01)
*B25B 23/14* (2006.01)
(Continued)

(52) U.S. Cl.
CPC ..... *B25B 23/147* (2013.01); *B25B 21/00* (2013.01); *B25B 23/14* (2013.01); *B25B 23/141* (2013.01); *B25B 23/145* (2013.01)

(58) Field of Classification Search
CPC ..... B25B 23/14–15
(Continued)

(56) References Cited

U.S. PATENT DOCUMENTS 3,939,920 A * 2/1976 Hardiman ..... B25B 23/1456 173/1
5,563,482 A * 10/1996 Shaw ..... B23P 19/066 173/176

(Continued)

FOREIGN PATENT DOCUMENTS

EP 2779418 A2 9/2014
JP 2001341079 A 12/2001

(Continued)

OTHER PUBLICATIONS

International Search Report (ISR) and Written Opinion dated Oct. 7, 2016 issued in International Application No. PCT/EP2016/063471.

(Continued)

*Primary Examiner* — Dariush Seif
(74) *Attorney, Agent, or Firm* — Holtz, Holtz & Volek PC

(57) ABSTRACT

A method is used for tightening screw joints by a power tool which includes a manually operated trigger for controlling power supply to the power tool, and a power shut-off mechanism for automatic discontinuation of the power tool operation as a predetermined tightening level is reached. The method includes continuously indicating a position of the trigger, indicating a status of the power shut-off mechanism, and disabling the power tool in an inoperative state for a predetermined time if the trigger is indicated as inactivated without the shut-off mechanism being indicated as activated.

7 Claims, 1 Drawing Sheet

(51) Int. Cl.
*B25B 21/00* (2006.01)
*B25B 23/145* (2006.01)

(58) Field of Classification Search
USPC ..... 173/1–11, 176–183
See application file for complete search history.

(56) References Cited

U.S. PATENT DOCUMENTS 5,657,417 A * 8/1997 Di Troia ..... B25F 5/00 173/148
7,777,612 B2 * 8/2010 Sampson ..... G08B 13/1427 173/2
9,000,882 B2 * 4/2015 Velderman ..... B25F 5/00 338/118
2002/0050364 A1 * 5/2002 Suzuki ..... B25B 21/02 173/1
2010/0024611 A1 * 2/2010 Starick ..... B25B 21/00 81/470
2010/0059240 A1 * 3/2010 Schmidt ..... B25B 21/00 173/1
2012/0160529 A1 * 6/2012 Eshleman ..... B25B 21/00 173/1
2013/0068491 A1 * 3/2013 Kusakawa ..... B25B 21/00 173/176
2013/0284480 A1 * 10/2013 Horie ..... B23B 45/02 173/217
2014/0262390 A1 * 9/2014 Arimura ..... B25B 21/02 173/7
2015/0231770 A1 * 8/2015 Kusakawa ..... B25B 21/02 173/93.5
2019/0262979 A1 * 8/2019 Arai ..... B25B 23/147

FOREIGN PATENT DOCUMENTS

JP 2012011502 A 1/2012
JP 2013198964 A 10/2013
WO 2011116452 A1 9/2011

OTHER PUBLICATIONS

Japanese Office Action (and English language translation thereof) dated Jul. 13, 2020 issued in Japanese Application No. 2017-567328.

* cited by examiner

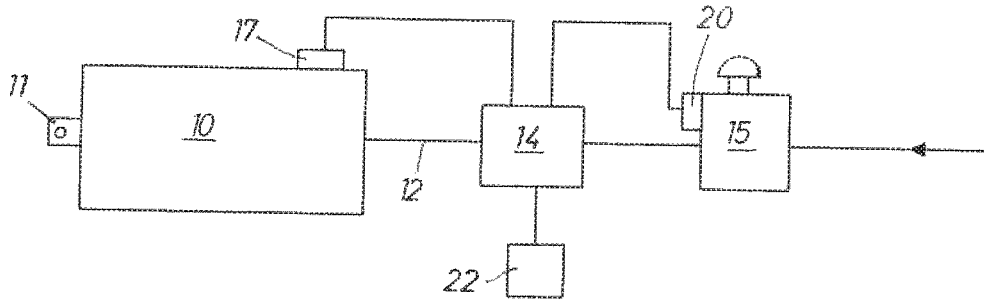
17
20
11
10
14
15
12
22

METHOD AND A POWER TOOL FOR ERROR PROOF SCREW JOINT TIGHTENING

The invention relates to a method and a power tool for preventing erroneous screw joint tightening due to premature discontinuation of the tightening process. In particular the invention concerns screw joint tightening by means of a trigger operated hand held power tool, wherein discontinuation of the tightening process is intended to be controlled by an automatic shut-off function in the power tool, comprising for instance a mechanical clutch, motor current sensing or similar means, which is set to shut off the power tool as a predetermined torque level is reached.

A problem concerned with screw joint tightening operations as described above is that the operator in some cases tries to speed up the tightening process by inactivating the trigger and make the power tool stop before the automatic shut-off means has been activated. This may be the case where a number of screw joints are to be tightened on an object, for instance on an assembly line where the working situation sometimes could be rather intense. Such a premature discontinuation of the tightening process means that the screw joint may not be tightened to the intended torque level, which may result in a faulty and less reliable screw joint and, hence a poor quality of the assembled object.

It is an object of the invention to provide a method and a power tool by which the operator does not benefit from interrupting the tightening process before the automatic shut-off means of the power tool is activated, thereby ensuring a complete tightening process as well as the quality and reliability of an assembled object.

This object is achieved by providing a screw joint tightening power tool with means for indicating a premature shut-off caused by the operator inactivating the trigger, and by providing a means for locking the power tool in an inoperative condition for a certain period of time after the premature discontinuation of the tightening process is indicated. Such a power tool disabling period is long enough to cause a substantial delay of the entire assembly operation compared to letting the power tool reach the intended tightening level and the automatic shut-off point.

Further objects and advantages of the invention will appear from the following specification and claims.

BRIEF DESCRIPTION OF THE DRAWING

FIG. 1 is a schematic illustration of a power tool arrangement according to the invention.

DETAILED DESCRIPTION

In FIG. 1, reference numeral 10 refers to the drive unit of a screw joint tightening power tool including an output shaft 11 for connection to a screw joint to be tightened. The drive unit 10 is connected to a power source via a supply line 12 including a power tool disabling device 14, and a manually operated trigger 15 located upstream thereof.

It is to be noted that within the scope of the invention the power tool may be a pneumatic tool supplied with pressure air via the supply line 12 which then is in the form of an air conduit, or an electric tool powered by electric current supplied via the supply line 12 which is in the form of an electric wiring.

The drive unit 10 comprises a non-illustrated shut-off mechanism which is set to accomplish an automatic discontinuation of the power tool operation as a certain tightening level is reached. This mechanism could comprise either a torque sensing means or an angle sensing means each set to identify a predetermined tightening level of the screw joint. Whichever sensing means being utilized there is provided a status indicating device 17 for generating a signal as the shut-off mechanism is activated. This signal is communicated to the disabling device 14 in order to accomplish a discontinuation of the power supply to the power tool as the shut-off mechanism is activated. The status indicating device 17 is illustrated as a laterally extending part of the drive unit 10 but is in practice located inside the latter.

The trigger 15 is provided with a position indicating device 20 illustrated symbolically as an external part and connected to the disabling device 14 for communicating signals in response to the trigger being inactivated.

The disabling device 14 will be activated if an inactivation signal is received from the trigger 15 without a signal being received from the shut-off mechanism of the power tool. A timer 22 is connected to the disabling device 14 and arranged to determine a certain period of time for which the disabling device 14 shall be activated. Accordingly, the timer 22 is set to accomplish a discontinuation of the power tool for a desired period of time thereby locking the power tool for further operation during that time interval.

It is to be noted that the shut-off mechanism comprised in the power tool may be of alternative types but having the function of interrupting the power tool operation as a certain tightening level is reached. The tightening level could be identified as a certain torque magnitude or a certain angular displacement of the screw joint, and accordingly the shut-off mechanism could comprise an angle sensor or a torque transducer to generate shut-off initiating signals. Alternatively, the shut-off mechanism could be a mechanical torque responsive release clutch, wherein the status indicating device 17 is arranged to be activated by the release movement of the clutch.

During a screw joint tightening process the power tool is applied on a screw joint and started by the operator activating the trigger 15. Power is supplied to the drive unit 10 and a torque is transferred to the screw joint. The shut-off mechanism is set to automatically interrupt the tightening process as a certain predetermined tightening level is reached, which means that the intended target tightening level is obtained. Should, however, the operator try to speed up an assembly operation by letting go of the trigger 15, i.e. inactivating the latter, before the automatic shut-off mechanism has been activated there is accomplished a premature shut-off of the power tool. In such a case an inactivating signal is sent to the disabling device 14 from the position indicating device 20 on the trigger 15 and since at that point the automatic shut-off mechanism is still not activated the disabling device 14 will be activated and lock the power tool from being restarted for a certain period of time determined by the timer 22.

Since a premature shut-off of the power tool during a screw joint tightening process, i.e. discontinuation of the tightening process before the shut-off mechanism has been activated means a risk that the screw joint is not properly tightened and that a faulty and unreliable screw joint would be the result. An automatic delay for restart the power tool will cause an interruption of the power tool use that is longer than the shortened time gained by the premature shut-off, which means that the operator will avoid premature shut-offs in future tightening operations and, thereby avoiding the risk for causing poor tightening results.

The invention claimed is:

1. A method for tightening screw joints by a power tool comprising a manually operated trigger for controlling power supply to the power tool, and a power shut-off mechanism for automatic discontinuation of the power tool operation as a predetermined tightening level is reached, wherein the method comprises:

starting a screw joint tightening operation by the power tool in response to the trigger being activated, and thereafter:

continuously indicating a position of the trigger;

indicating a status of the power shut-off mechanism; and locking the power tool in an inoperative state, in which the power tool is prevented from being restarted, for a predetermined time in response to the trigger being indicated as inactivated before the predetermined tightening level is reached and the shut-off mechanism is indicated as being activated.

2. The method according to claim 1, wherein the predetermined tightening level is identified as a certain torque magnitude.

3. The method according to claim 1, wherein the predetermined tightening level is identified as a certain angular displacement of the screw joint.

4. A screw joint tightening power tool comprising:

a drive unit;

a manually operated trigger that is shiftable between an ON-position and an OFF-position for controlling power supply to the drive unit;

a shut-off mechanism for automatic interruption of power tool operation as a predetermined tightening level is reached;

a trigger position indicating device;

a status indicating device for the shut-off mechanism;

a timer; and a disabling device connected to the trigger position indicating device, the status indicating device for the shut-off mechanism, and the timer, wherein the disabling device is configured to, after a screw joint tightening operation by the power tool is started in response to the trigger being in the ON-position, lock the power tool in an inoperative state, in which the power tool is prevented from being restarted, for a predetermined time set on the timer, in response to the trigger being in the OFF-position before the predetermined tightening level is reached and the shut-off mechanism is indicated as being activated.

5. The power tool according to claim 4, wherein the shut-off mechanism comprises a torque sensing unit including the status indicating device.

6. The power tool according to claim 5, further comprising an electric motor, wherein the torque sensing unit comprises a motor current sensing device.

7. The power tool according to claim 4, wherein the shut-off mechanism comprises an angle sensing unit including the status indicating device.

* * * * *